US005315337A

United States Patent [19]

Skye

[11] Patent Number: 5,315,337

[45] Date of Patent: May 24, 1994

[54] PHOTOGRAPHIC FILM PROCESSING

[75] Inventor: David A. Skye, Harpenden, Great Britain

[73] Assignee: Eastman Kodak Company, Rochester, N.Y.

[21] Appl. No.: 854,641

[22] PCT Filed: Dec. 14, 1990

[86] PCT No.: PCT/EP90/02108

§ 371 Date: Jul. 2, 1992

§ 102(e) Date: Jul. 2, 1992

[87] PCT Pub. No.: WO91/10941

PCT Pub. Date: Jul. 25, 1991

[30] Foreign Application Priority Data

Jan. 11, 1990 [GB] United Kingdom ..... 9000637

[51] Int. Cl.[5] ..... G03D 13/00; G03D 3/08

[52] U.S. Cl. ..... 354/298; 354/319; 354/320; 354/324

[58] Field of Search ..... 354/297-299, 354/319-324, 337

[56] References Cited

U.S. PATENT DOCUMENTS 2,296,048 9/1942 Planskoy .
3,462,221 8/1969 Tajima et al. .
3,680,463 8/1972 Attridge et al. ..... 354/298
3,785,268 1/1974 Gregg et al. ..... 354/298
4,881,095 11/1989 Shidara ..... 354/298
5,179,405 1/1993 Osada et al. ..... 354/324

FOREIGN PATENT DOCUMENTS 1200243 12/1959 France .

*Primary Examiner*—D. Rutledge
*Attorney, Agent, or Firm*—Nixon, Hargrave, Devans & Doyle

[57] ABSTRACT

In known film processing techniques, the amount by which a film is processed at each stage is determined chiefly by time. If a film is either over- or underexposed, it may be incorrectly processed producing unsatisfactory results. The present invention utilises an arrangement which measures changes in the infrared density of the film during processing to ensure that satisfactory results are produced. The arrangement comprises an infrared light emitting diode (22) and an infrared sensitive photodiode detector (26) which are both mounted in a support (20). Film (34) passes between the diode (22) and the detector (26) so that the amount of infrared radiation being transmitted through the film can be determined to provide a measure of the infrared density of the film at each stage during its processing.

13 Claims, 1 Drawing Sheet

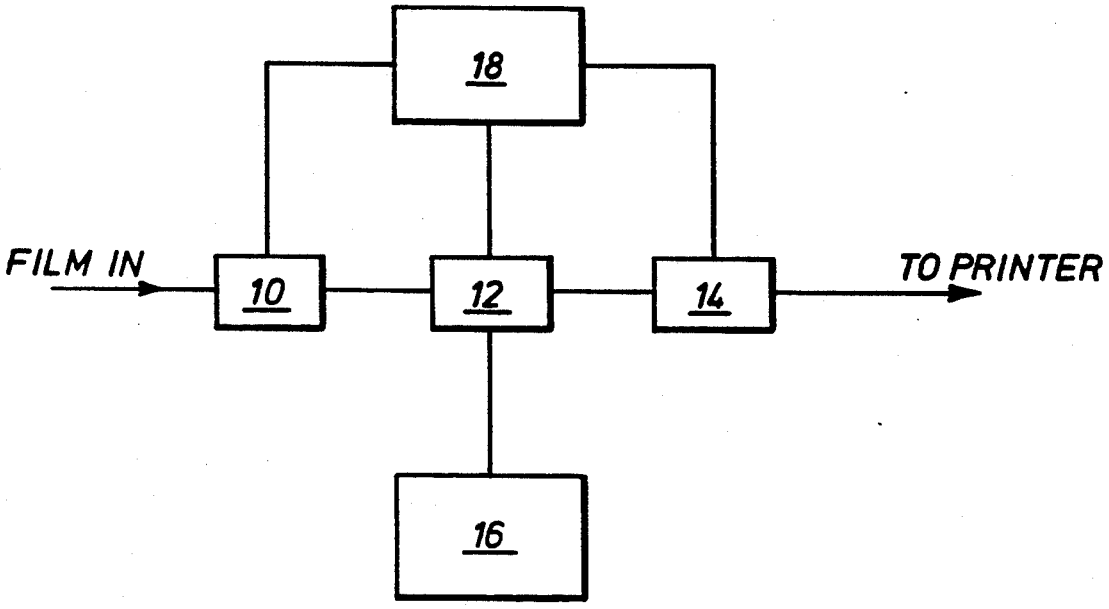
Fig. 1.
FIG. 2.
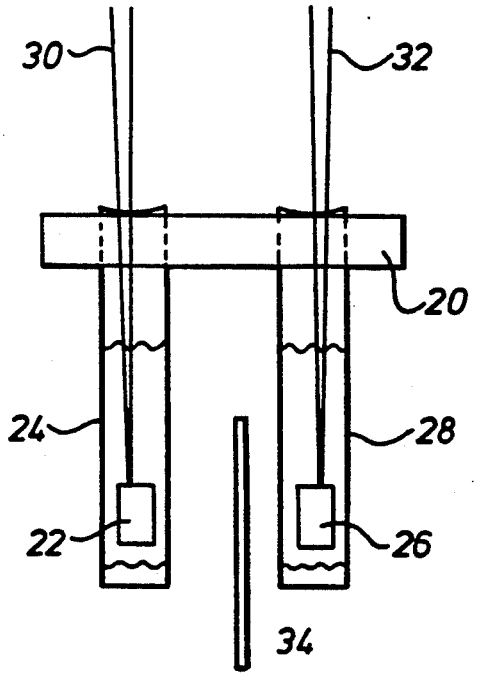

PHOTOGRAPHIC FILM PROCESSING

This invention relates to photographic film processing, and is more particularly concerned with the control of such processing.

U.S. Pat. No. 2 296 048 discloses a method of photographic development which relates to a predetermined value of contrast. The method comprises subjecting two areas of the film to be developed to two exposures of different values and observing two radiant beams through these two areas during the development process. The intensities of the two radiant beams are chosen so that the difference between the logarithms of these intensities corresponds to the difference in densities to be obtained in the two areas after correct development. Suitable infrared filters can be used to absorb all radiation to which the emulsion being developed is sensitive.

U.S. Pat. No. 3 680 463 relates to a method and apparatus for selectively processing silver halide photographic film or the like by following the steps of partially developing the latent image on the film in a standard developing solution, scanning the film with infrared radiation, sensing the density of discrete areas of the film by sensing the amount of infrared radiation reflected or transmitted through the partially exposed film, using information relating to the infrared radiation reflected or transmitted through the film to automatically control the temperature of processing of discrete areas of the film and thereafter finishing the developing process in a conventional developing bath.

U.S. Pat. No. 3 785 268 relates to apparatus for developing X-ray film and allows the film to be developed with any desired density within know limitations regardless of whether the film has been over- or under-exposed. The apparatus incorporates a control system which responds to the scanning of the exposed film in a developing solution by an infrared beam to which the film is relatively insensitive and which causes the developing process to be terminated when a desired density is achieved. Very clear and very opaque areas of the film are eliminated from the processing and the desired density is establisted by processing the film between such minima and maxima.

FR-A-1 200 243 discloses development and processing apparatus in which the density or range of densities of a photographic emulsion or other sensitive material can be rigourously controlled during development. Development of the emulsion or other sensitive material is terminated when a predetermined value is reached which corresponds to the difference in infrared energy supplied to the detector through two control zones.

In standard film processing techniques, the exposed film is developed, bleached and then fixed prior to printing. At each stage of the processing technique, the amount of developing, bleaching, or fixing tends to be determined by time. This can lead to incorrect processing of films which are either over-or under-exposed thereby producing unsatisfactory results.

It is known that during film processing, the levels of silver and/or silver halide present in the film change in each of the development, bleaching and fixing stages. It is an object of the present invention to utilise means for measuring such changes in the silver and/or silver halide levels to control the processing process.

According to one aspect of the present invention, there is provided a film processing apparatus comprising a plurality of film processing stations, each station executing a predetermined step in the processing operation and includes infrared monitoring means, characterized in that the infrared monitoring means measures the density of silver and/or silver halide present in the film.

By this arrangement, optimum processing of an exposed film can be achieved.

Advantageously, the monitoring means comprises an infrared source and an infrared detector. In a preferred embodiment, the infrared light source is an infrared light emitting diode, and the infrared detector is an infrared sensitive photodiode.

Preferably, the source and detector are spectrally matched, and operate on a wavelength of around 950 nm.

In a preferred embodiment of the invention, a computer is used for sensing the output of the detector, and for controlling switching of the film being processed from one station to another in response to that output.

Control strips of known exposure can be processed in a similar way to film having unknown exposures in order to monitor and control the process activity.

For a better understanding of the present invention, reference will now be made, by way of example only, to the accompanying drawing in which:

FIG. 1 illustrates a schematic block diagram of film processing apparatus for use with a device according to the invention; and FIG. 2 illustrates an embodiment of an infrared monitoring device used in the apparatus of FIG. 1.

It is known that the quantity of silver or silver halide in a film can be measured using infrared techniques, the infrared density being a function of the quantity of silver or silver halide present. An unprocessed film consists mainly of silver halide and has a predetermined infrared density value. This value of infrared density will not vary substantially from film to film and is independent of the latent image present on the film itself.

Referring to FIG. 1, film processing apparatus is shown in block diagram form. The apparatus comprises a developing station 10, a bleaching station 12, and a fixing station 14. The exposed film is processed by passing it through each station 10, 12, and 14, in turn before passing it to a photographic printer (not shown). The time for which the film is at each one of the stations in the processing apparatus is determined using a device as shown in FIG. 2.

FIG. 2 shows a device for sensing the infrared density of a film and can be used at any one of the three processing stations mentioned above. The device comprises a support 20 which carries an infrared light emitting diode (LED) 22, and an infrared photodiode detector 26. The LED 22 and detector 26 are sealed in respective transparent plastics tubes 24, 28 and they are spaced apart by the support 20 as shown. Film 34 is arranged to pass close to the detector 26 so that the infrared density sensed by the amount of radiation passing from the LED 22, through the film 34, and on to the detector 26, approximates to the diffuse density of the film. The absolute value of the density is unimportant.

The LED 22 is driven at a constant current from a power supply 16 (see FIG. 1) by means of connections 30. The detector 26 is spectrally matched to the LED 22. The wavelength of the infrared radiation emitted by the LED 22 is around 950 nm.

The detector 26, when operating in its linear short circuit current mode, produces a signal which represents transmission of infrared radiation through the film 34. The signal from the detector 26 is converted to a density value by a monolithic logarithmic amplifier (not shown) to provide an output signal which corresponds to the density value. This signal is monitored by a computer 18 (see FIG. 1) through connections 32, and when it reaches a predetermined value, depending on the processing station, completes that particular processing step and allows the film to be passed on to the next station (or to the printer).

Whilst the film is in the developing station 10, the silver halide present in the film is converted to metallic silver. This causes a rise in the infrared density. The rate at which this rise occurs depends on the exposure of the film. If left in the developer, the rate of rise of the infrared density would continue to rise until all the silver halide had been converted to metallic silver. However, under normal conditions, the development process is terminated after a predetermined default time, for example after 3.25 minutes as in the C41 process, and the film is passed to the bleaching station 12.

If the rate of rise of the infrared density in the film is above a predetermined limit, then the film can be considered to be over-exposed. The development time is reduced to compensate for this over-exposure. If the rate of rise of the infrared density is below another predetermined limit, then the film can be considered to be under-exposed and the development time is increased to compensate. Within these two predetermined limits exists a range of infrared density values for which the default development time can be used.

In the bleaching station 12, the film is bleached which causes the metallic silver to be oxidised back to silver halide. As a consequence, the infrared density returns to its original value prior to development. Once this density value has been attained, that is the infrared density has fallen to a steady low level, bleaching is completed and the film is then passed to the fixing station 14.

In the fixing station 14, the film is fixed, and the silver halide is made soluble so that it can be washed out of the film. This has the result that the infrared density falls to zero. Once a zero reading is sensed, the film is then washed, stabilised and dried before being passed to the printer.

Therefore, by carefully monitoring the infrared density of the film during each of its processing stages, processing can be accurately controlled to produce optimum results prior to printing.

This invention can be used for any silver based film process but it is particularly applicable to cyclic film processes in which the film circulates around a fixed path until that stage of the process is complete, and the film is switched to the next stage of the process.

Control strips of known exposure can be used as standards. When these strips are processed, the rate of rise of the infrared density should always be the same, and therefore the processing time should be the same for each strip. Any variation in the processing time in one or each of the stations can be used to check the process activity.

Using apparatus according to the invention, the following can be monitored or detected:

(a) completion of the bleaching stage;
(b) completion of the fixing stage;
(c) aging of the fixer solution;
(d) under- or over-exposed film to allow compensation for this in the development time to permit optimum development for the film; and
(e) development rate of control strips as a check on the process activity.

I claim:

1. Film processing apparatus comprising a plurality of film processing stations, each station executing a step in the processing operation and monitoring means located at least two of said plurality of film processing stations, each monitoring means measuring the density of silver and/or silver halide present in the film and control means for detecting the density measured by each of said monitoring means and controlling the switching of the film from one station to another in response to the measured density.

2. Apparatus according to claim 1, wherein each monitoring means comprises an infrared source, an infrared detector.

3. Apparatus according to claim 2, wherein the infrared source is an infrared light emitting diode.

4. Apparatus according to claim 2, wherein the infrared detector is an infrared sensitive photodiode.

5. Apparatus according to claim 2, wherein the source (22) and detector (26) are spectrally matched, and operate on a wavelength of around 950 nm.

6. Apparatus according to claim 2, wherein the source (22) and detector (26) are sealed in respective transparent tubes (24, 28) and mounted in a support (20), the support (20) providing a sufficient spacing between the source (22) and the detector (26) to allow passage of the film (34) being processed.

7. Apparatus according to claim 2 further comprising a computer (18) for sensing the output of the monitoring means (20, 22, 24, 26, 28) and for controlling switching of the film (34) being processed from one station to another in response to that output.

8. Apparatus according to claim 2, wherein control strips of known exposure are processed to monitor and control the process activity.

9. Apparatus according to claim 1 wherein said plurality of film processing stations comprise a developing, bleaching and fixing station.

10. Film processing apparatus comprising a plurality of film processing stations, each station executing a step in the processing operation, monitoring means located at each station for measuring the density of silver and/or silver halide present in the film and control means for detecting the density measured by each of said monitoring means and controlling the switching of the film between stations in response to the measured density.

11. Apparatus according to claim 10 wherein said plurality of film processing stations comprise a developing, bleaching and fixing station.

12. Film processing apparatus comprising a plurality of film processing stations, each station executing a step in the processing operation and monitoring means located at at least two of said plurality of film processing stations, each monitoring means monitoring and controlling the execution of this step at the station, wherein each monitoring means comprises an infrared source and an infrared detector, wherein the source in detector are sealed in respective transparent tubes and mounted in a support, the support providing a sufficient spacing between the source and the detector to allow passage of the film being processes.

13. Film processing apparatus comprising a plurality of film processing stations, each station executing a step in the processing operation and monitoring means located at at least two of said plurality of film processing stations, each monitoring means monitoring and controlling the execution of this step at the station, wherein each monitoring means comprises an infrared source and an infrared detector, and further comprising a computer for sensing the output of the monitoring means and for controlling switching of the film being processed from one stage to another in response to that output.

* * * * *

UNITED STATES PATENT AND TRADEMARK OFFICE

CERTIFICATE OF CORRECTION

PATENT NO. : 5,315,337
DATED : May 24, 1994
INVENTOR(S) : Skye

It is certified that error appears in the above-indentified patent and that said Letters Patent is hereby corrected as shown below:

Column 4, line 56, delete "processes" and insert -- processed--.

Signed and Sealed this

Thirtieth Day of August, 1994

*Attest:*

*Attesting Officer*

BRUCE LEHMAN

*Commissioner of Patents and Trademarks*